US007930779B2

(12) United States Patent
Marrache

(10) Patent No.: US 7,930,779 B2
(45) Date of Patent: Apr. 26, 2011

(54) MATTRESS COVER

(76) Inventor: Albert Abraham Marrache, Cote St. Luc (CA)

( * ) Notice: Subject to any disclaimer, the term of this patent is extended or adjusted under 35 U.S.C. 154(b) by 0 days.

(21) Appl. No.: 12/326,156

(22) Filed: Dec. 2, 2008

(65) Prior Publication Data

US 2009/0144900 A1 Jun. 11, 2009

Related U.S. Application Data

(60) Provisional application No. 61/012,637, filed on Dec. 10, 2007.

(51) Int. Cl.

| | |
|---|---|
| ***A47C 21/02*** | (2006.01) |
| *A47G 9/02* | (2006.01) |
| *A47G 9/00* | (2006.01) |
| *A47C 31/00* | (2006.01) |

(52) U.S. Cl. ..... 5/498; 5/496; 5/500; 5/501; 5/502

(58) Field of Classification Search ..... 5/484, 482, 5/494, 499, 500, 501, 502, 496, 497, 498, 5/691

See application file for complete search history.

(56) References Cited

U.S. PATENT DOCUMENTS

| | | | | |
|---|---|---|---|---|
| 4,961,982 | A * | 10/1990 | Taylor | 428/91 |
| 4,985,953 | A | 1/1991 | Seago | |
| 5,042,099 | A | 8/1991 | Brenner et al. | |
| 5,056,441 | A | 10/1991 | Seago | |
| 5,086,530 | A | 2/1992 | Blake | |
| 5,127,115 | A | 7/1992 | Williams et al. | |
| 5,249,322 | A | 10/1993 | Seago | |
| 5,636,393 | A | 6/1997 | Zafiroglu et al. | |
| 6,859,962 | B2 | 3/2005 | Diak/Ghanem | |
| 2004/0040090 | A1 * | 3/2004 | Wootten | 5/497 |

* cited by examiner

*Primary Examiner* — Jonathan J Liu

(74) *Attorney, Agent, or Firm* — Honigman Miller Schwartz and Cohn LLP

(57) ABSTRACT

A mattress cover for covering a portion of a mattress that generally has a top surface and a plurality of side panels. The mattress cover generally comprises a waterproof cover, a fabric cover and at least one fastener to secure the fabric cover to the waterproof cover. The waterproof cover has at least one waterproof layer or portion for covering at least a portion of the top surface of the mattress. The at least one waterproof layer or portion has a plurality of edges. The fabric cover is removably securable to the waterproof cover.

7 Claims, 4 Drawing Sheets

MATTRESS COVER

RELATED APPLICATION

This application claims priority from, and incorporates by reference the contents of, U.S. provisional patent application 61/012,637, filed Dec. 10, 2007.

FIELD OF THE INVENTION

This invention relates to bedding, and in particular to mattress covers.

BACKGROUND OF THE INVENTION

Mattress covers or protectors are removable items of bedding that are placed on or attached to a mattress.

Mattress covers are used for various reasons. For example, mattress covers may be used to protect mattresses from spills or other contaminants which may pass through the bed sheets. It is often difficult and/or expensive to clean mattresses.

In addition, mattress covers may be used to reduce exposure of the user to allergens or other irritants that may exist in the mattress. For the above reasons, the use of mattress covers has been increasing.

Traditionally, mattress covers have been made from a plastic or vinyl type material that is laid across the top of the mattress or that is fitted over the top and side surfaces. While such products are relatively efficient in protecting the mattress from spills or other contaminants, and also for reducing the exposure of the user to allergens or irritants that may exist in the mattress, they have a tendency to cause users to perspire and to trap excessive amounts of body heat and water vapour. Plastic or vinyl material from which such mattress covers have traditionally been manufactured also has a tendency to be slippery, making it difficult to maintain sheets and other bedding material in place upon the mattress. Plastic or vinyl material is also somewhat difficult to clean as it is not as conducive to washing in typical household washers and dryers. There is therefore the need for an improved form of mattress cover.

SUMMARY OF THE INVENTION

A selectively-configurable covering is disclosed. The selectively-configurable covering includes a first unit, a second unit and a fastener. The first unit includes a plurality of layers. The plurality of layers of the first unit includes: a first layer including an upper surface and a lower surface, a second layer including an upper surface and a lower surface, and a third layer including an upper surface and a lower surface. The first layer of the plurality of layers of the first unit is a first fabric layer. The second layer of the plurality of layers of the first unit is a plush layer. The third layer of the plurality of layers of the first unit is second fabric layer. The plush layer is disposed between the first fabric layer and the second fabric layer. The upper surface of the plush layer is disposed directly adjacent the lower surface of the first fabric layer. The lower surface of the plush layer is disposed directly adjacent the upper surface of the second fabric layer. The second unit includes a plurality of layers. The plurality of layers of the second unit includes: a first layer including an upper surface and a lower surface, and a second layer including an upper surface and a lower surface. The first layer of the plurality of layers of the second unit is a waterproof layer. The second layer of the plurality of layers of the second unit is a third fabric layer. The lower surface of the waterproof layer is disposed directly adjacent the upper surface of the third fabric layer. The fastener permits selective-attachment of the first unit to the second unit. The fastener includes a first fastener portion and a second fastener portion. The first fastener portion is attached to the lower surface of the second fabric layer of the first unit. The second fastener portion is attached to the upper surface of the waterproof layer of the second unit.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment and in which.

DETAILED DESCRIPTION

Figure 1:
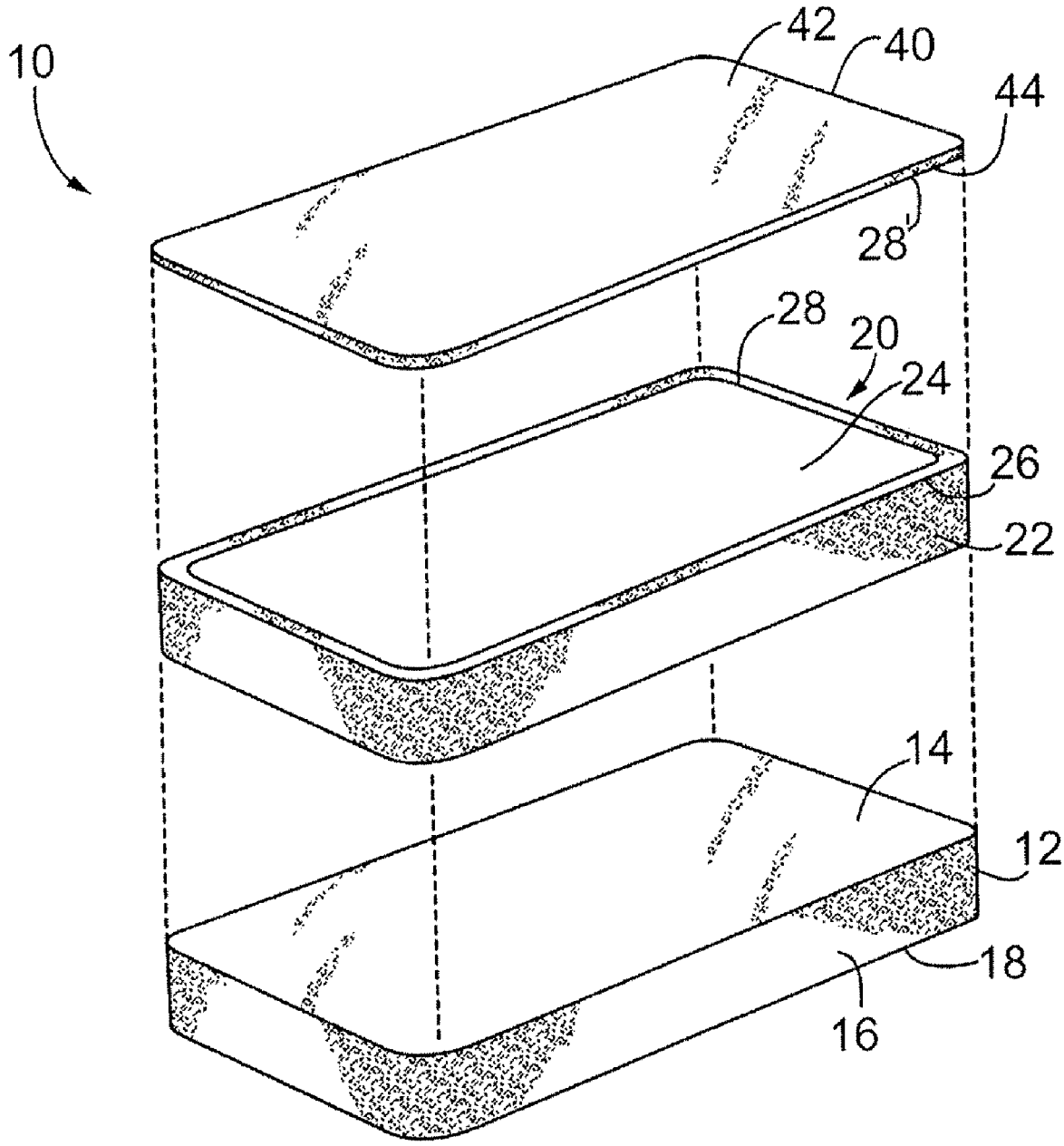
FIG. 1 is an exploded perspective view of one of the preferred embodiments of the mattress cover according to the present invention.

It will be appreciated that, for simplicity and clarity of illustration, where considered appropriate, reference numerals may be repeated among the figures to indicate corresponding or analogous elements. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments claimed herein in any way but rather as merely describing the implementation of the various embodiments described herein.

FIG. 1 shows a mattress cover 10, according to a first embodiment of the present invention, which is attachable to a mattress 12 to cover a portion of the mattress. In this embodiment the mattress 12 is composed of a generally rectangular top surface 14, four side panels 16 and a bottom 18.

Referring again to FIG. 1, the mattress cover in accordance with a preferred embodiment of the invention includes a waterproof cover 20 and a fabric cover 40. In one embodiment the waterproof cover 20 has at least one waterproof layer or portion 24 for covering at least a portion of the top surface of the mattress. The at least one waterproof layer or portion 24 has a plurality of edges. In an alternate embodiment the waterproof cover 20 includes a fabric layer or portion 26 positioned beneath the waterproof layer or portion 24 and adjacent to the top surface of the mattress when the mattress cover is positioned on the mattress. The waterproof cover 20 may include, in a further embodiment, a side skirt 22 that is preferably secured to the waterproof cover along the plurality of edges of the waterproof layer. The side skirt 22 may be constructed so that it is at least partially resilient to assist in removably securing the waterproof cover to the corners of the mattress. That is, the side skirt may be stretchable around the side panels 16 of the mattress 12 in order to help secure waterproof cover 20 thereto. Alternately, the corners of the side skirt may be resilient or elasticized in order to secure the waterproof cover to the corners of the mattress. Further, lateral straps (not shown) may be attached to the side skirts for running beneath the bottom of the mattress, and to thereby connect to the side skirts on opposite sides and securely hold the waterproof cover in place. While it will be appreciated by those skilled in the art that the material from which the upper end lower layers 24 and 26 (that comprise the waterproof cover 20) are made may vary, in one embodiment lower layer 26 is a terry cloth, velour, micro fiber or similar type fabric while upper waterproof layer 24 is a vinyl, polyurethane or plastic-type material, that may also be breathable. It will also be appreciated that in an alternate embodiment of the invention the relative position of layers 24 and 26 may be reversed, with the waterproof layer next or adjacent to the top surface of the mattress when the mattress cover is positioned on the mattress.

Preferably, the fabric cover 40 is generally rectangular in shape and is capable of covering at least a portion of the top surface of the mattress. Cotton piping (not shown) may be provided around the edges of the fabric cover 40. The fabric cover 40 is preferably made up of an upper fabric layer 42 and a lower fabric layer 44. The lower fabric layer 44 may include a polypropylene backing and the upper fabric layer 42 may be treated using a suitable stain resistant treatment. Fabric cover 40 may also include a skirt (not shown) to assist in securing it to the mattress. Quilting material 60 may be positioned between layers 42 and 44 to enhance the plushness of the fabric cover.

Continuing to refer to FIG. 1, at least one fastener is provided for removably securing the fabric cover 40 to the waterproof cover 20. The fastener may be composed of cooperating portions 28, 28' secured to the waterproof cover 20 and fabric cover 40, respectively. Preferably the portion 28 of the fastener extends around the edge of the upper layer 24, and the portion 28' of the fastener extends around the edge of the fabric cover 40. In the embodiment shown in FIG. 1, the fastener is a zipper. However, it will be understood by those skilled in the art that any other suitable fastener or cover fastening means, such as hook and loop fasteners, adhesive strips, snaps, buttons, hooks, magnets, elastics, and resealable adhesives. In addition, the portions 28, 28' of the fasteners need not extend around the entire edge of the waterproof cover 20 and fabric cover 40. Instead, the fasteners may be attached only to portions of the waterproof cover 20 and fabric cover 40.

In operation of the mattress cover 10 according to a first embodiment, the waterproof cover 20 may be secured to the mattress 12 by stretching the side skirt 22 around the side panels 16. If adding the fabric cover 40 is desired, it may then be zipped or otherwise attached to the waterproof cover 20. The mattress cover 10 may be removed from the mattress 12 either by first unzipping the fabric cover 40 or by simply pulling the waterproof cover 40 off the mattress (with the fabric cover 40 attached).

Figure 2:
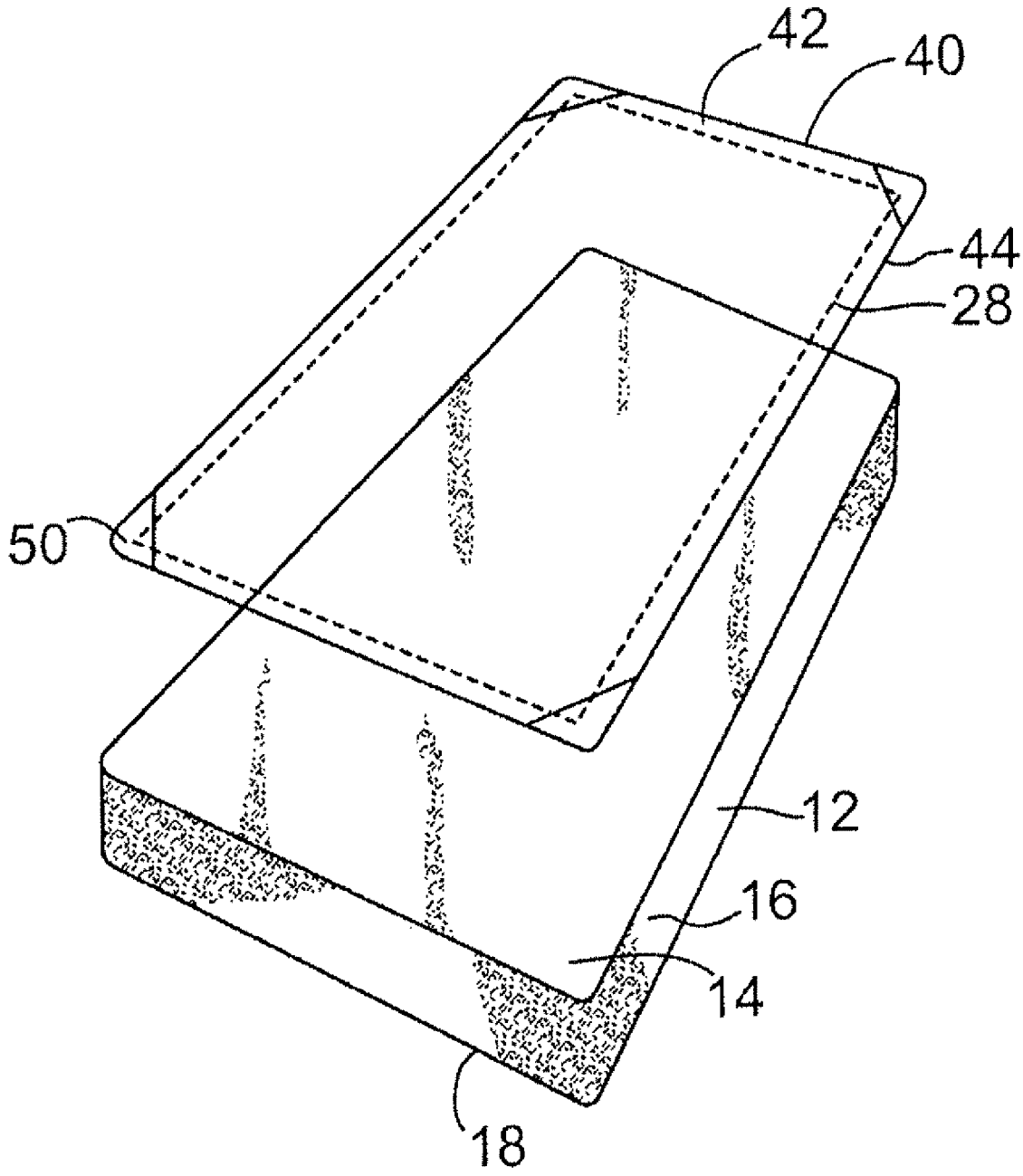
FIG. 2 is an exploded perspective view illustrating a second embodiment of the mattress cover.
Figure 3:
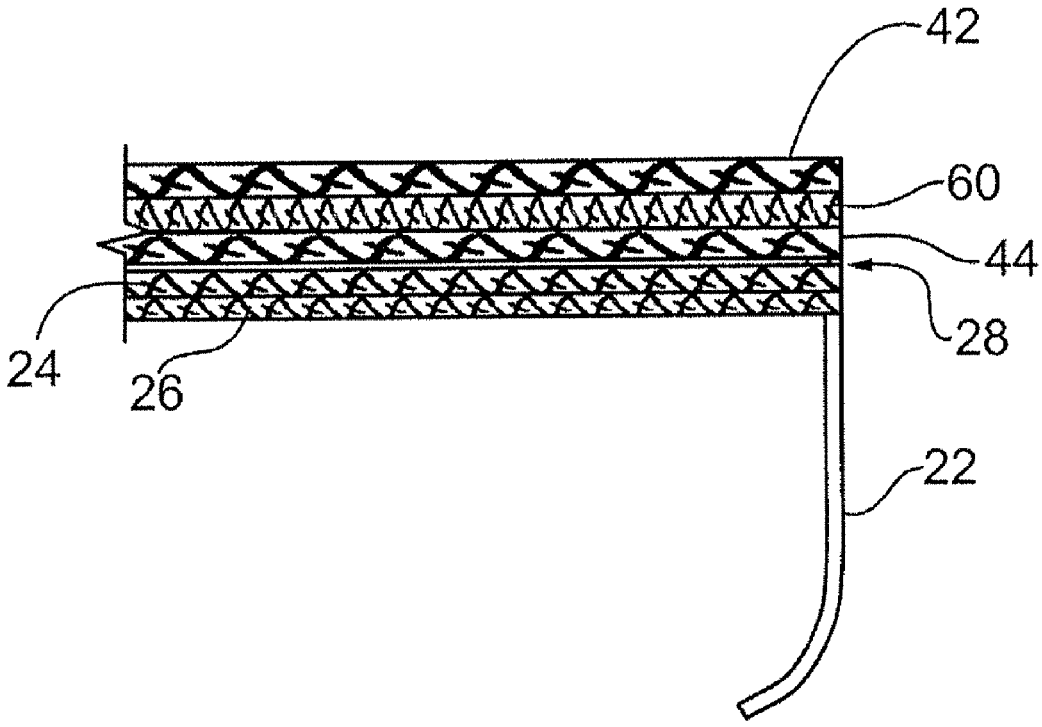
FIG. 3 is a vertical sectional view through one of the preferred embodiments of the invention; and, FIG. 4 is an exploded perspective view of an alternate embodiments of the mattress cover shown in FIG. 1.

FIG. 2 shows a second embodiment of the mattress cover 10. The waterproof cover 20 (not shown in FIG. 2) of this embodiment is identical to the first embodiment and will not be further described. The fabric cover 40 is preferably similar to that described in the first embodiment, except that it includes at least one attachment 50 to removably secure the fabric cover 40 to the mattress 12. Preferably, attachment 50 comprises elastic bands or elasticized straps which are connected to the corners of the fabric cover 40 and that are receivable about the corners of the mattress. In alternative embodiments, the fabric cover 40 may have a skirt that is stretchable around the side panels 16.

The operation of the second embodiment will now be described with reference to FIG. 2. In the second embodiment the mattress cover may be attached to the mattress 12 as described for the first embodiment (i.e. by attaching the waterproof cover to the mattress 12, and then zipping the fabric cover 40 to the waterproof cover 20 if desired). In addition, the fabric cover 40 may be removably secured directly to the mattress 12 by stretching the elastics of the mattress attachments 50 over each of the corners of the mattress 12. If desired, the waterproof cover 20 may be placed on top of the fabric cover 40 and secured to the mattress 12 using the side skirt 22. Accordingly, the second embodiment provides an additional advantage by permitting additional configurations for the mattress cover 10. Specifically, the second embodiment permits the use of the waterproof cover 20 alone, the fabric cover 40 alone, the fabric cover 40 on top of the waterproof cover 20, or the waterproof cover 20 on top of the fabric cover 40.

Figure 4:
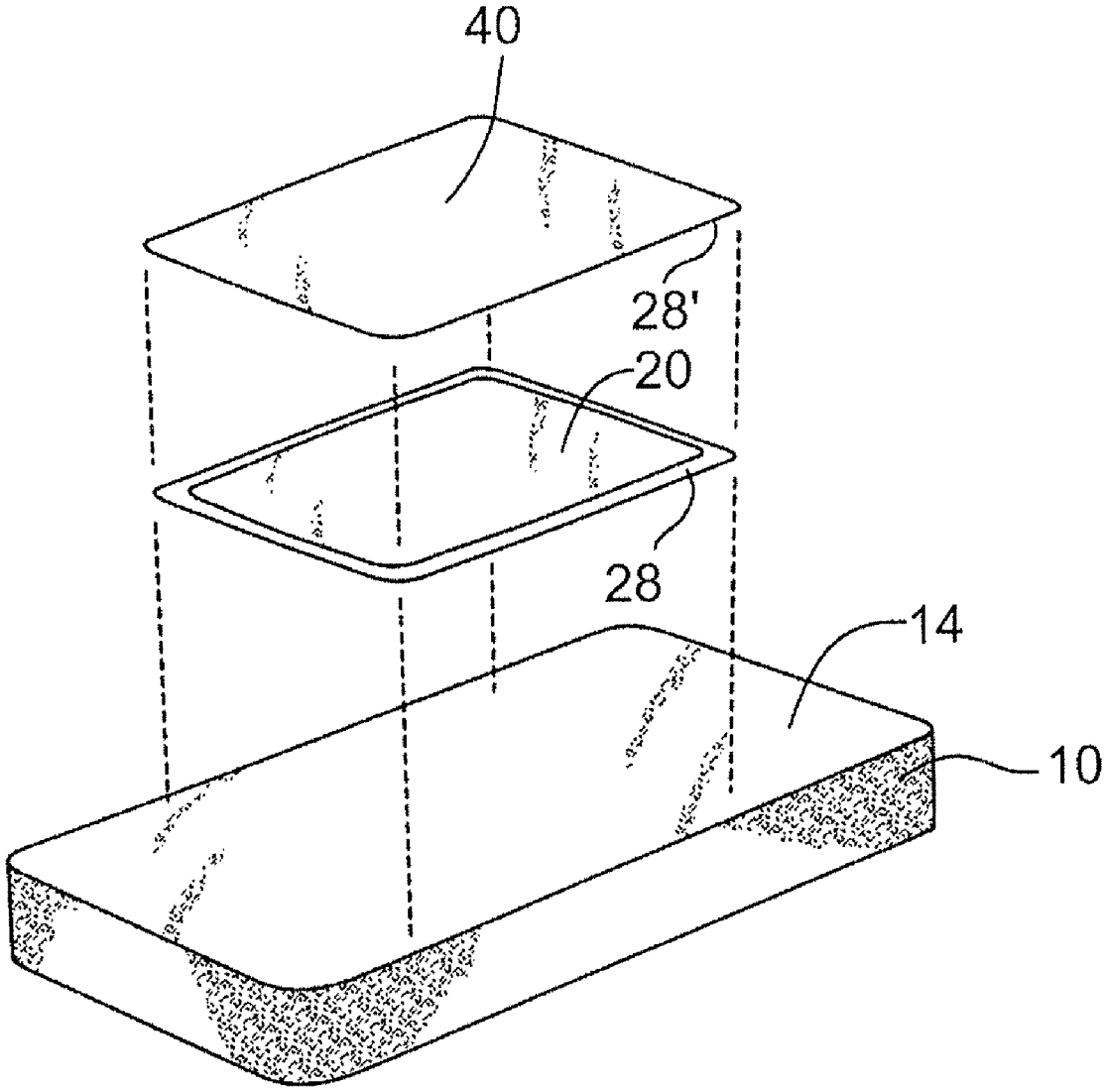

Though the mattress cover 10 is described with regards to adult mattresses of any size, the present invention may be used with any type of bed upon which there is a mattress-like element. For example, the mattress cover 10 may be used with a futon, crib, hospital bed, geriatric care bed, or waterbed. Further, while in FIGS. 1 and 2 the mattress cover is shown as covering all or substantially all of the upper surface of the mattress, it will be understood that the cover could be designed to cover only part or portion of the upper surface of the mattress (see FIG. 4). In addition, while a generally rectangular mattress has been described the mattress and the mattress cover can be of any variety of shapes.

While the above description provides examples of particular embodiments of the invention, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

I claim:

1. A selectively-configurable covering, comprising:

a first unit, wherein the first unit includes a plurality of layers, wherein the plurality of layers of the first unit includes: a first layer including an upper surface and a lower surface, a second layer including an upper surface and a lower surface, and a third layer including an upper surface and a lower surface, wherein the first layer of the plurality of layers of the first unit is a first fabric layer, wherein the second layer of the plurality of layers of the first unit is a plush layer, wherein the third layer of the plurality of layers of the first unit is a second fabric layer, wherein the plush layer is disposed between the first fabric layer and the second fabric layer, wherein the upper surface of the plush layer is disposed directly adjacent the lower surface of the first fabric layer, wherein the lower surface of the plush layer is disposed directly adjacent the upper surface of the second fabric layer; a second unit, wherein the second unit includes a plurality of layers, wherein the plurality of layers of the second unit includes: a first layer including an upper surface and a lower surface, and a second layer including an upper surface and a lower surface, wherein the first layer of the plurality of layers of the second unit is a waterproof layer, wherein the second layer of the plurality of layers of the second unit is a third fabric layer, wherein the lower surface of the waterproof layer is disposed directly adjacent the upper surface of the third fabric layer; a fastener that permits selective-attachment of the first unit to the second unit, wherein the fastener includes a first fastener portion and a second fastener portion, wherein the first fastener portion is attached to the lower surface of the second fabric layer of the first unit, wherein the second fastener portion is attached to the upper surface of the waterproof layer of the second unit; a skirt portion, wherein the skirt portion is attached to and extends from the lower surface of the third fabric layer of the second unit, wherein the first unit includes a shape having four corners; and an elasticized strap connected to the first unit at each corner of the four corners, wherein the elasticized strap at each corner of the four corners of the first unit provides means for selectively configuring the selectively-configurable covering in each of at least the following four configurations relative to a mattress: a first configuration wherein the second unit cover covers at least a portion of the mattress without the first unit, a second configuration wherein the first unit covers at least a portion of a top surface of the mattress without the second unit, a third configuration wherein the second unit cover covers at least a portion of the mattress and the first unit is located on top of the second unit; and a fourth configuration wherein the first unit covers at least a portion of the top surface of the mattress and the second unit is located on the top of the first unit.

2. The selectively-configurable covering according to claim 1, wherein the fastener is selected from the group consisting of:

a zipper, a hook and loop fastener, adhesive strips, a button, a hook, elastics, a magnet or a snap-fastener.

3. The selectively-configurable covering according to claim 1, wherein the first fabric layer of the first unit includes:

a stain-resistant treatment.

4. The selectively-configurable covering according to claim 1, wherein the plush layer of the first unit includes:

a quilting material.

5. The selectively-configurable covering according to claim 1, wherein the second fabric layer of the first unit includes:

a polypropylene backing.

6. The selectively-configurable covering according to claim 1, wherein the waterproof layer of the second unit includes:

a vinyl, polyurethane or plastic material.

7. The selectively-configurable covering according to claim 1, wherein the third fabric layer of the second unit includes:

a terry cloth, velour, or micro-fiber material.

* * * * *